US008241069B2

(12) United States Patent
Yamaji

(10) Patent No.: US 8,241,069 B2
(45) Date of Patent: Aug. 14, 2012

(54) CONNECTOR

(75) Inventor: Takahiro Yamaji, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/172,041

(22) Filed: Jun. 29, 2011

(65) Prior Publication Data

US 2012/0003866 A1 Jan. 5, 2012

(30) Foreign Application Priority Data

Jun. 30, 2010 (JP) ..... 2010-148785

(51) Int. Cl.
*H01R 24/00* (2006.01)
*H01R 33/00* (2006.01)

(52) U.S. Cl. ..... 439/660; 439/495

(58) Field of Classification Search ..... 439/527, 439/660, 492, 493, 495, 680, 79, 607.37
See application file for complete search history.

(56) References Cited

U.S. PATENT DOCUMENTS

| | | | | |
|---|---|---|---|---|
| 6,695,642 | B2 | 2/2004 | Shindo et al. | |
| 7,172,455 | B2 | 2/2007 | Pabst et al. | |
| 7,597,584 | B2 * | 10/2009 | Yamaji | 439/495 |

FOREIGN PATENT DOCUMENTS

| | | | |
|---|---|---|---|
| JP | 48-67287 | U | 8/1973 |
| JP | 56-13371 | U | 2/1981 |
| JP | 1-132078 | U | 9/1989 |
| JP | 05-72084 | U | 9/1993 |
| JP | 10-255921 | A | 9/1998 |
| JP | 10-321314 | A | 12/1998 |
| JP | 11-026103 | A | 1/1999 |
| JP | 2002-289285 | A | 10/2002 |
| JP | 2002-324609 | A | 11/2002 |
| JP | 2006-505107 | A | 2/2006 |
| JP | 2006-085989 | A | 3/2006 |
| JP | 2007-258126 | A | 10/2007 |
| JP | 2010-062072 | A | 3/2010 |

OTHER PUBLICATIONS

Japanese Office Action dated Feb. 23, 2012 (and English translation thereof) in counterpart Japanese Application No. 2010-148785.

* cited by examiner

*Primary Examiner* — Javaid Nasri
(74) *Attorney, Agent, or Firm* — Holtz, Holtz, Goodman & Chick, PC

(57) ABSTRACT

A connector has a mating portion matable with a mating connector. The connector is provided with a plurality of contacts and a holder member holding the plurality of contacts arrayed in a pitch direction. The mating portion has an upper surface, a lower surface, and a tip potion. Each of the plurality of contacts includes a contacting part and a folded part. The contacting part is exposed on the upper surface of the mating portion. The contacting part extends frontward and has a front end. The front end is exposed on the tip potion of the mating portion. The folded part is folded backward from the front end of the contacting part and has a rear end as an embedment part. The holder member has a plate portion defining an external shape of the mating portion. The embedment part is embedded in the plate portion.

7 Claims, 5 Drawing Sheets

CONNECTOR

CROSS REFERENCE TO RELATED APPLICATIONS

Applicant claims priority under 35 U.S.C. §119 of Japanese Patent Application No. JP2010-148785 filed Jun. 30, 2010.

BACKGROUND OF THE INVENTION

The present invention relates to a connector having a plate-like mating portion matable with a mating connector.

JP-A2010-62072 discloses a connector having a plate-like mating portion. The connector is mated with a mating connector by inserting the mating portion into a receiver portion of the mating connector. The mating portion includes a holder member made of an insulating resin and a plurality of contacts held on the holder member. Each of the contacts has an end having a shape like a crank. Tips of the ends of the contacts are embedded in the holder member.

When the connector of JP-A 2010-62072 is mated with the mating connector, mating contacts of the mating connector are guided to the contacts by the holder member, so that connection is established between the mating contacts and the contacts.

In the connector of JP-A2010-62072, however, the holder member may be shaved when the holder member guides the mating contacts because the holder member is made of an insulating resin while the mating contacts are made of metal. If shaved wastes are inserted between the mating contacts and the contacts, then connection between the mating contacts and the contacts becomes defective.

SUMMARY OF THE INVENTION

It is therefore an object of the present invention to provide a connector capable of eliminating the drawbacks of the connector disclosed in JP-A 2010-62072 so as to enhance the contact reliability.

One aspect of the present invention provides a connector which has a mating portion matable with a mating connector. The connector is provided with a plurality of contacts and a holder member holding the plurality of contacts arrayed in a pitch direction. The mating portion has an upper surface, a lower surface, and a tip potion. Each of the plurality of contacts includes a contacting part and a folded part. The contacting part is exposed on the upper surface of the mating portion. The contacting part extends frontward and has a front end. The front end is exposed on the tip potion of the mating portion. The folded part is folded backward from the front end of the contacting part and has a rear end as an embedment part. The holder member has a plate portion defining an external shape of the mating portion. The embedment part is embedded in the plate portion.

An appreciation of the objectives of the present invention and a more complete understanding of its structure may be had by studying the following description of the preferred embodiment and by referring to the accompanying drawings.

Figure 1:
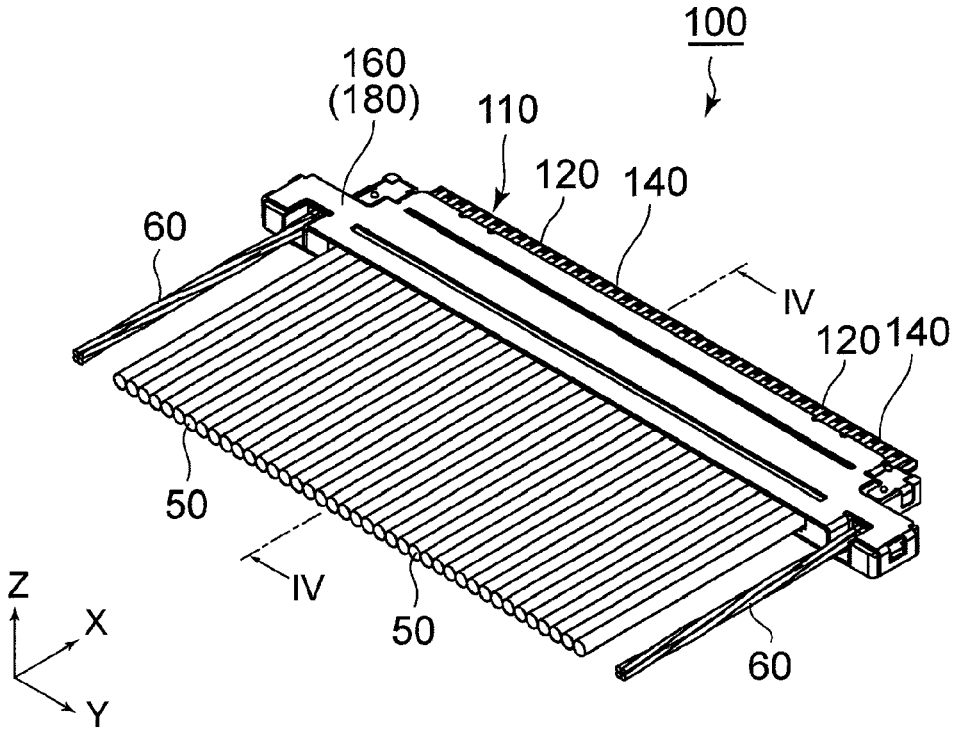
FIG. 1 is a perspective view showing an upper side of a connector (plug connector) according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 4:
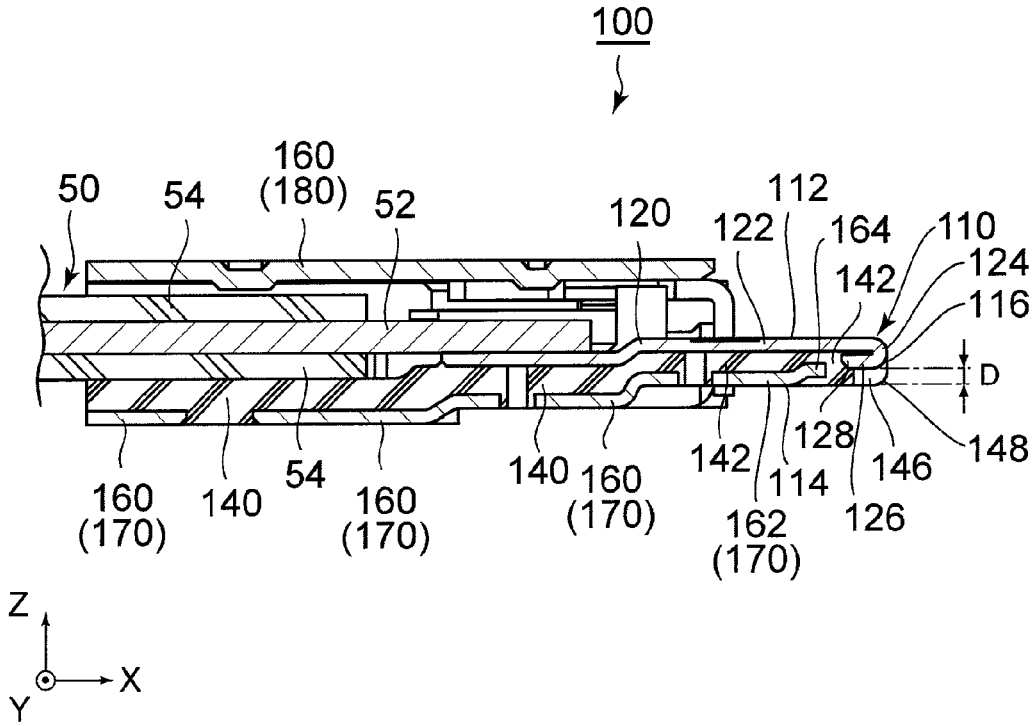
FIG. 4 is a cross-sectional view of the connector taken along lines IV-IV of FIG. 1.

Referring to FIGS. 1, 2, 7, and 9, a connector 100 according to an embodiment of the present invention is a plug connector having a plate-like mating portion 110, which projects (frontward) in the X-direction. The connector 100 is mated with a receptacle connector, or a mating connector 200, so as to form a connector assembly 10. As shown in FIG. 4, the mating portion 110 of the connector 100 has an upper surface 112, a lower surface 114, and a tip potion 116.

Figure 7:
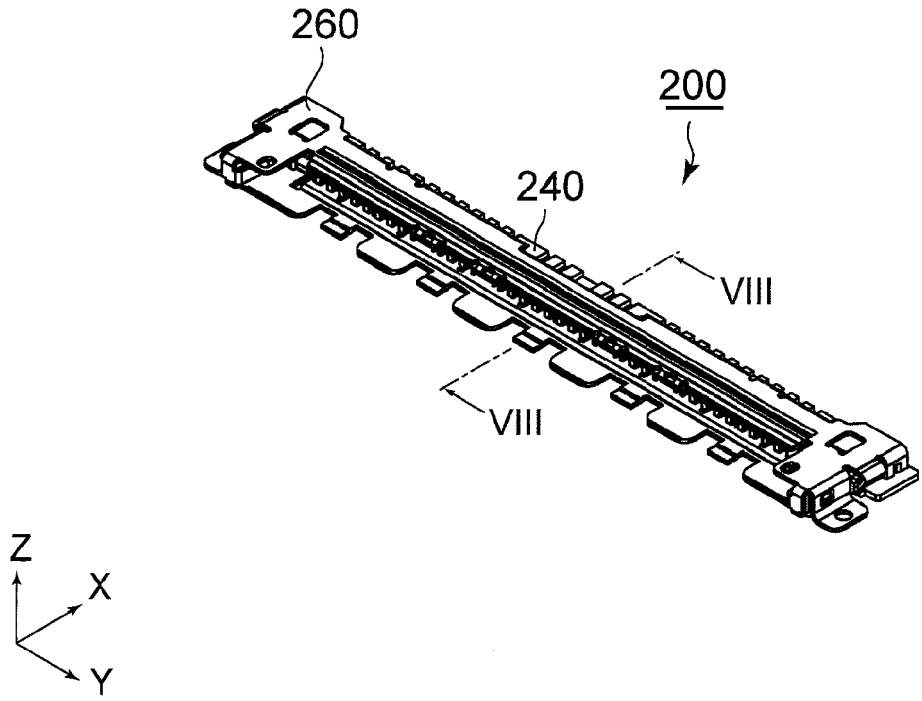
FIG. 7 is a perspective view showing an upper side of a mating connector (receptacle connector).
Figure 8:
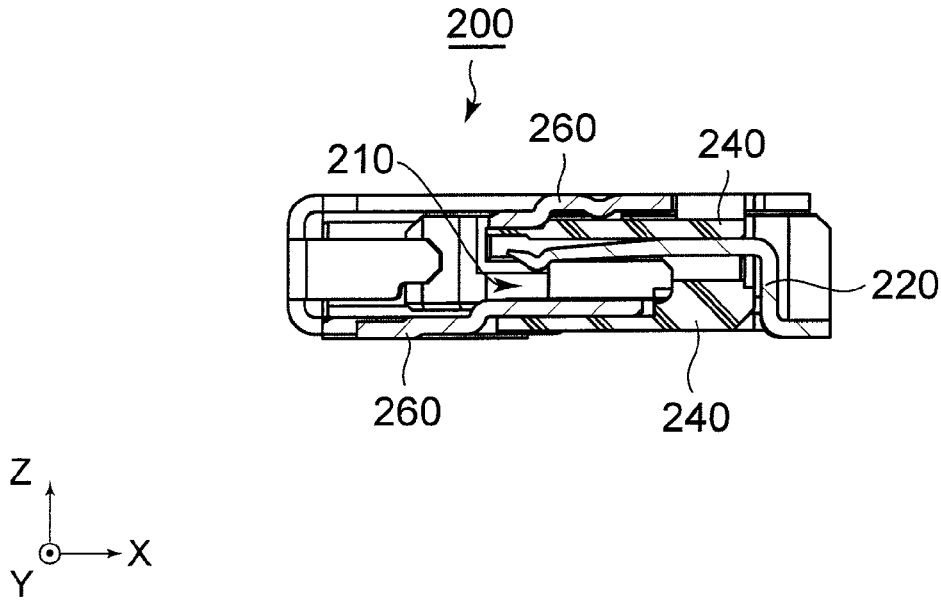
FIG. 8 is a cross-sectional view of the mating connector taken along lines VIII-VIII of FIG. 7.
Figure 9:
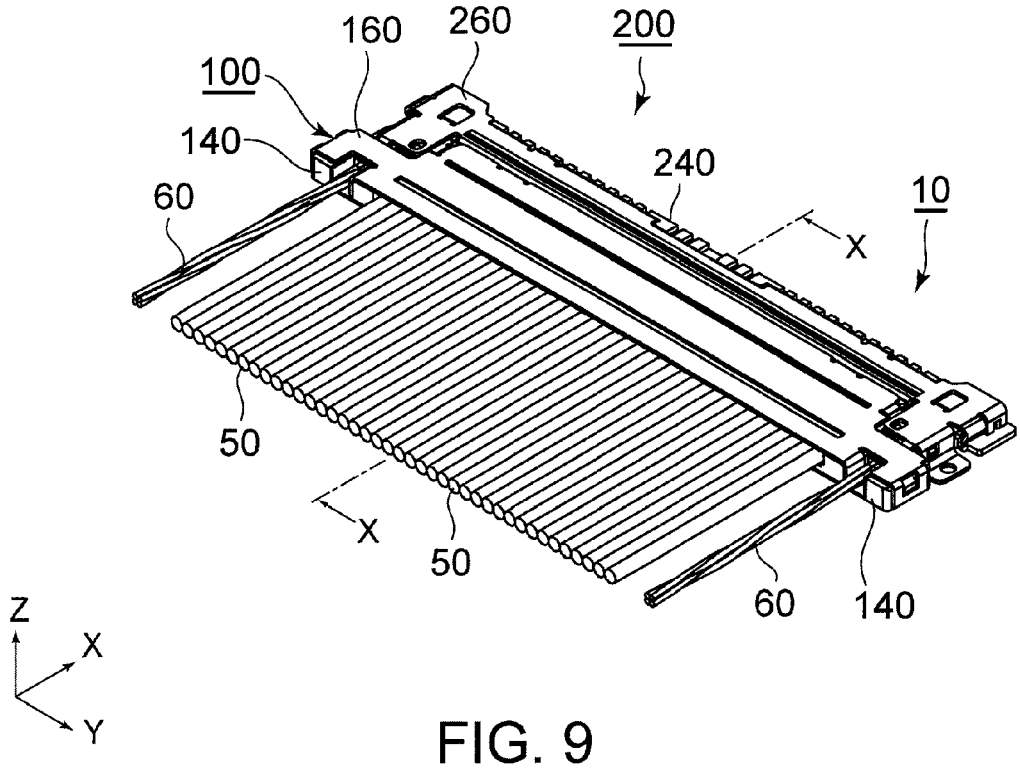
FIG. 9 is a perspective view showing an upper side of a connector assembly including the connector of FIG. 1 and the mating connector of FIG. 7, in which the connector has been mated with the mating connector.
Figure 10:
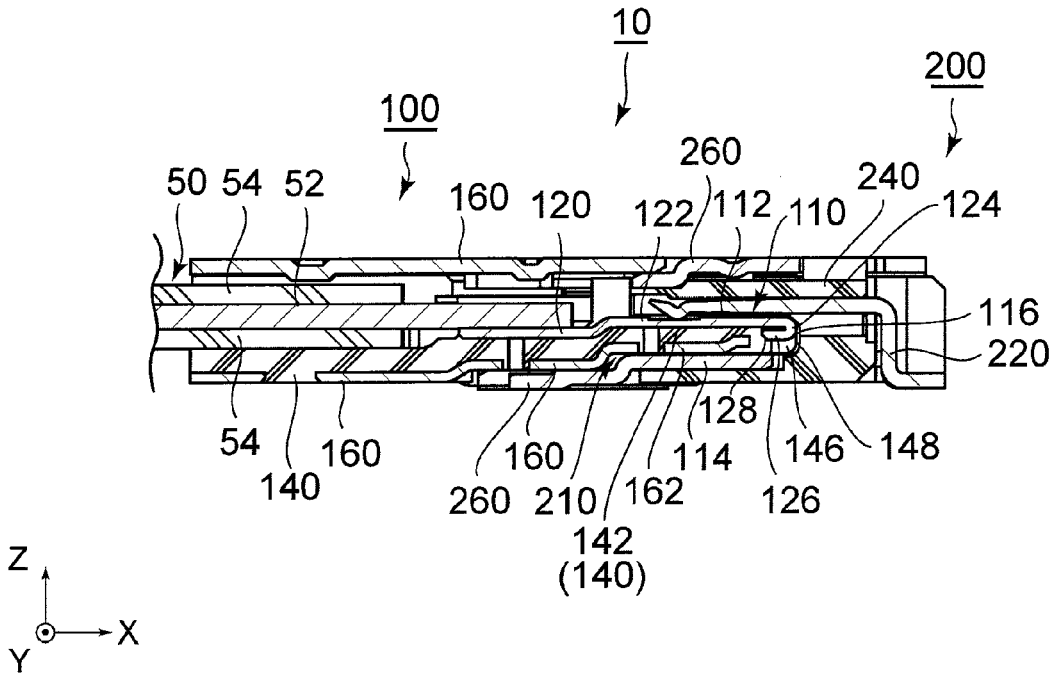
FIG. 10 is a cross-sectional view of the connector assembly taken along lines X-X of FIG. 9.

Referring to FIGS. 7 and 8, the mating connector 200 has a plurality of mating contacts 220, a mating holder member 240 configured to hold the mating contacts 220, and a mating shell 260 partially covering the mating holder member 240. The mating contacts 220 are made of metal. The mating holder member 240 is made of an insulating material. The mating shell 260 is made of metal. The mating connector 200 has a receiver portion 210. As shown in FIGS. 9 and 10, the connector 100 is mated with the mating connector 200 by inserting the mating portion 110 of the connector 100 into the receiver portion 210 of the mating connector 200, so that the connector assembly 10 is formed.

Referring to FIGS. 1 to 4, the connector 100 has a plurality of contacts 120, a holder member 140 holding the contacts 120, and a shell 160 partially covering the holder member 140. The contacts 120 are made of metal. The holder member 140 is made of an insulating material. The shell 160 is made of metal. The connector 100 is connected with drain lines 60 and a plurality of signal lines (discrete lines) 50, each of which includes a signal conductor 52 and an insulative covering 54. As can be seen from FIGS. 4, 8, and 10, the mating portion 110 of the connector 100 is received into the receiver portion 210 of the mating connector 200, so that the connector 100 is mated with the mating connector 200. At that time, the contacts 120 are brought into contact with the mating contacts 220, and a shell contacting part 162 of the shell 160 is brought into contact with the mating shell 260.

Figure 2:
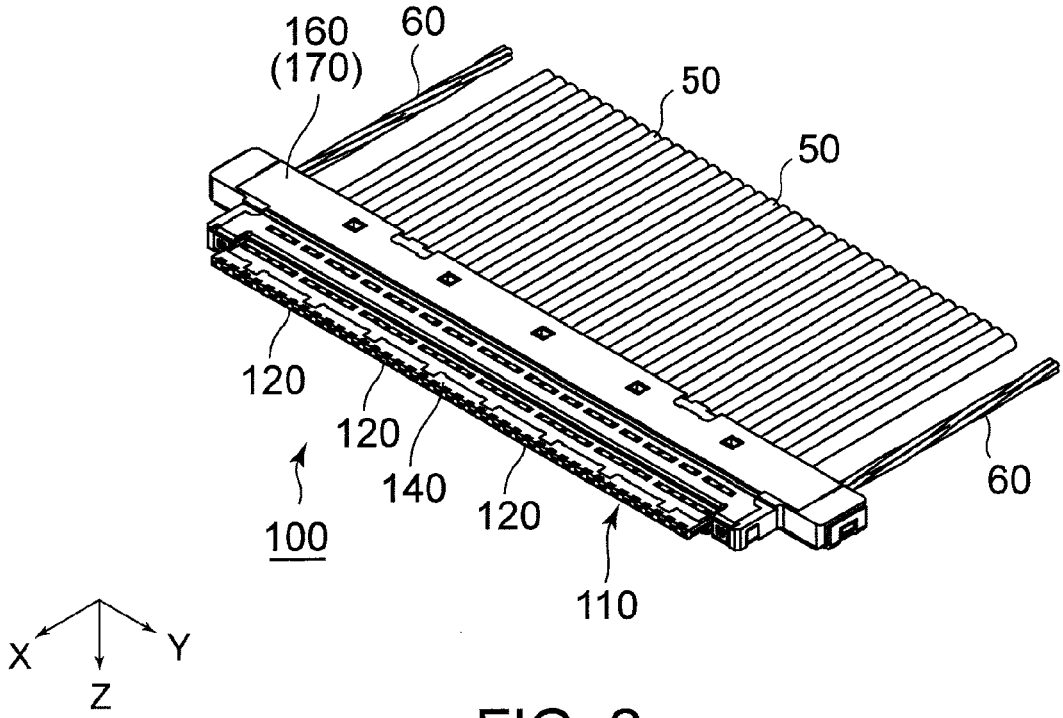
FIG. 2 is a perspective view showing a lower side of the connector of FIG. 1.
Figure 3:
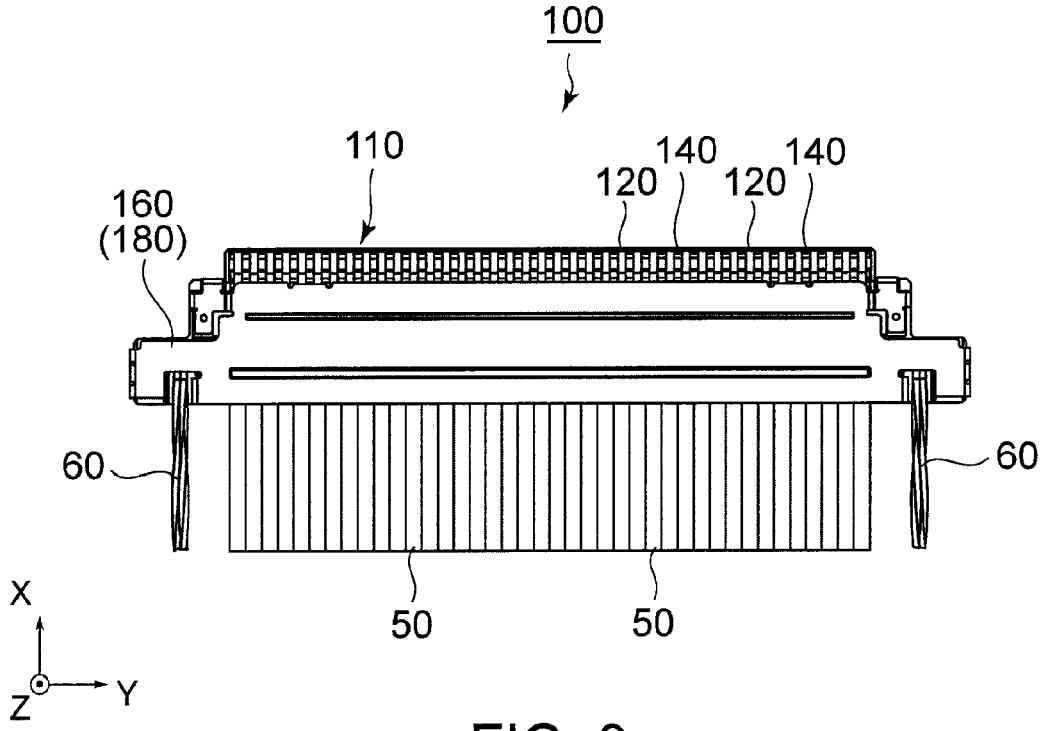
FIG. 3 is a plan view showing the connector of FIG. 1.
Figure 5:
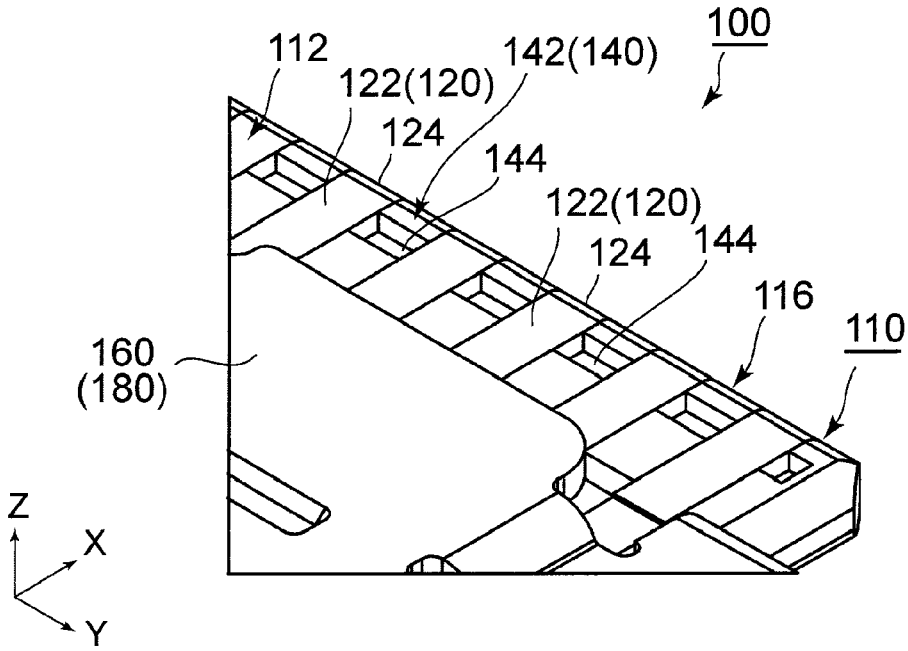
FIG. 5 is an enlarged perspective view showing part of a mating portion of the connector of FIG. 1.
Figure 6:
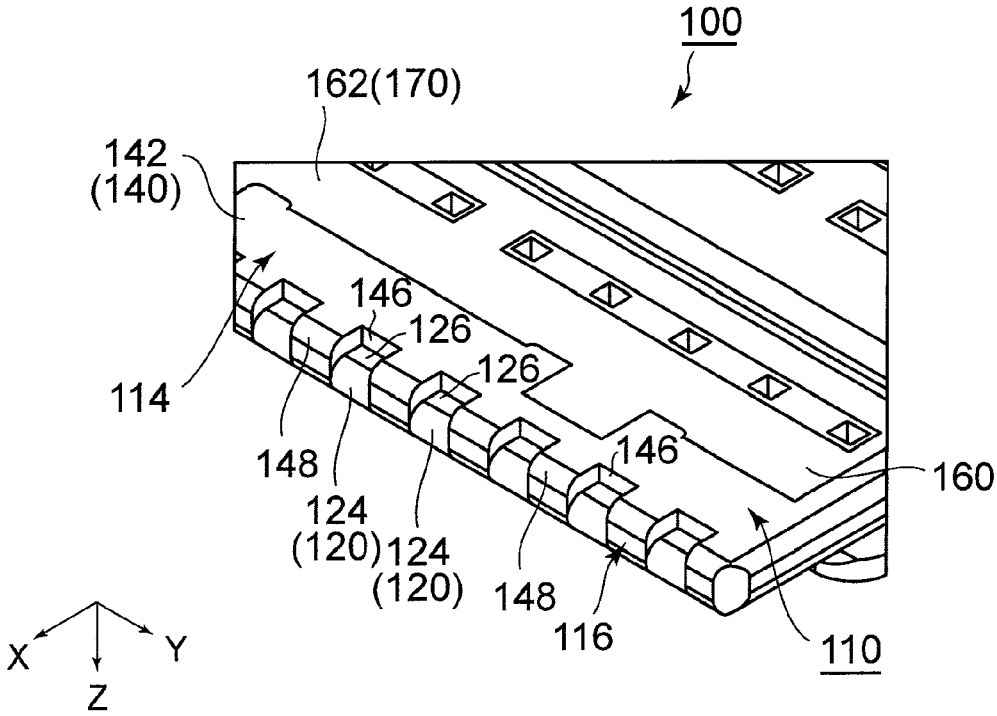
FIG. 6 is an enlarged perspective view showing part of the mating portion of the connector of FIG. 2.

As shown in FIGS. 1 to 3, the contacts 120 are held on the holder member 140 such that the contacts 120 are arranged along the Y-direction (pitch direction). As shown in FIG. 4, each of the contacts 120 includes a contacting part 122 extending (frontward) in the positive X-direction and a folded part 126 folded (backward) in the negative X-direction from a front end 124 of the contacting part 122. The contacting parts 122 are brought into contact with the mating contacts 220. As shown in FIGS. 4 and 5, the contacting parts 122 are exposed on the upper surface 112 of the mating portion 110. Particularly, as shown in FIGS. 4 and 6, the front ends 124 of the contacting parts 122 of this embodiment are exposed at the tip potion 116 of the mating portion 110. Specifically, the front end 124 of each of the contacting parts 122 can be seen from the front of the mating portion 110 (along the negative X-direction). During formation of the holder member 140, the contacts 120 are incorporated into the holder member 140 by a mold-in-place method. At the time of the incorporation, embedment parts 128 on rear ends of the folded parts 126 are embedded in the holder member 140.

Referring to FIGS. 1 to 4, the shell 160 includes a base shell 170 and a cover shell 180. During the formation of the holder member 140, the base shell 170 is incorporated into the holder member 140 by a mold-in-place method. The cover shell 180 partially covers an upper surface of the holder member 140. The base shell 170 has a shell contacting part 162 that is brought into contact with the mating shell 260 when the connector 100 is mated with the mating connector 200. As shown in FIGS. 4 and 6, the shell contacting part 162 is exposed on the lower surface 114 of the mating portion 110. Specifically, the base shell 170 is incorporated in (or attached to) the holder member 140 such that the shell contacting part 162 is exposed on the lower surface 114 of the mating portion 110.

As shown in FIGS. 1 to 4, the holder member 140 has a plate portion 142. The plate portion 142 defines an external shape of the mating portion 110. Specifically, the contacting parts 122 of the contacts 120 are exposed on an upper surface of the plate portion 142, and the front ends 124 of the contacting parts 122 are exposed on a tip potion of the plate portion 142. Furthermore, the embedment parts 128 on the rear ends of the folded parts 126 are embedded in the plate portion 142. Moreover, the shell contacting part 162 is exposed on a lower surface of the plate portion 142. At least part of a tip potion 164 of the shell contacting part 162 is also embedded in the plate portion 142 as with the embedment parts 128 of the contacts 120. The tip potion 164 and the embedment parts 128 are opposed to each other with a gap formed therebetween. The thickness of the plate portion 142 (the size in the Z-direction) is determined such that the distance D from a lower surface of the shell contacting part 162 to lower surfaces of the folded parts 126 of the contacts 120 is greater than the thickness of the shell 160 (the base shell 170).

As shown in FIG. 5, the plate portion 142 has holes 144 formed in an upper surface of the plate portion 142. As shown in FIGS. 4 and 6, the plate portion 142 has recessed portions 146 formed in the lower surface of the plate portion 142. The holes 144 and the recessed portions 146 are formed by portions of a metal mold that are used to position the contacts 120 when the contacts 120 are incorporated into the holder member 140 by a mold-in-place method. Specifically, the holes 144 correspond to portions of the metal mold that are used to define the pitches of the contacts 120 (the intervals in the Y-direction). Therefore, the contacts 120 adjacent to one of the holes 144 have side surfaces partially exposed within the hole 144. The recessed portions 146 correspond to portions of the metal mold that are used to define the position of the contacts 120 in the Z-direction (the vertical direction). Accordingly, the recessed portions 146 allow portions of the folded parts 126 of the contacts 120 other than the embedment parts 128 to be seen from below the lower surface 114 of the mating portion 110. Thus, in the present embodiment, the portions of the folded parts 126 other than the embedment parts 128 can be seen through the recessed portions 146 from a lower side of the connector 100. Nevertheless, the present invention is not limited to this example. For example, at least part of the folded parts 126 of the contacts 120 may be seen through the recessed portions 146.

Referring to FIG. 6, the recessed portions 146 are formed for each of the contacts 120. Ribs 148 are formed between the recessed portions 146 located adjacent to each other in the Y-direction (pitch direction). Each of the ribs 148 extends downward (toward the negative Z-direction) more than the folded parts 126 and constitutes a lower part of the tip potion 116 near the lower surface 114 of the mating portion 110.

In the present embodiment, the front ends 124 of the contacting parts 122 are exposed on the tip potion 116 of the mating portion 110. In other words, the front ends of the contacts 120 are exposed on the tip potion 116 of the mating portion 110. Therefore, according to the present embodiment, the holder member 140 is prevented from being shaved by contact of the mating contacts 220 with the holder member 140 when the connector 100 is mated with the mating connector 200. As a result, defective connection between the contacts 120 and the mating contacts 220, which would be caused by shaved wastes or the like, can be prevented.

Furthermore, according to the present embodiment, even though the recessed portions 146 are formed, the ribs 148 can prevent the mating shell 260 from being brought into contact with the contacts 120 when the connector 100 is mated with the mating connector 200. Particularly, the ribs 148 locate the contacts 120 away from the mating shell 260. Therefore, even if an inspection is performed with power being supplied, a short circuit can be prevented from being caused by contact between the contacts 120 and the mating shell 260.

Moreover, in the present embodiment, the distance D is set to be greater than the thickness of the shell 160 (the base shell 170). The lower surface of the shell contacting part 162 is brought into contact with the mating shell 260 when the connector 100 is mated with the mating connector 200. The distance D from the lower surface of the shell contacting part 162 to the lower surfaces of the folded parts 126 of the contacts 120 is equal to a distance from the mating shell 260 to the folded parts 126 in the mating state. Since the distance D is greater than the thickness of the shell 160, the folded parts 126 can be spaced from the mating shell 260 in the mating state. Therefore, it is possible to avoid unfavorable electric connection between the folded parts 126 and the mating shell 260.

In the aforementioned embodiment, the signal lines 50 and the drain lines 60 are connected to the connector 100. Nevertheless, the present invention is not limited to this example. For example, the present invention is applicable to any plug connector connectable to a receptacle connector similar to the receptacle connector described in the above embodiment.

In the aforementioned embodiment, the shell 160 is formed by two members of the base shell 170 and the cover shell 180. However, the shell 160 may be formed of a single member. Nevertheless, it is preferable to use two members of the base shell 170 and the cover shell 180 in order to achieve reduction in thickness of the connector 100.

Furthermore, in the aforementioned embodiment, the shell contacting part 162 is provided on the mating portion 110 in order to minimize a path to a ground portion of a circuit board (not shown) on which the mating connector 200 has been mounted. However, the present invention is not limited to this example. The shell contacting part 162 may be eliminated from the mating portion 110 in a case where requirements for the ground are tempered.

According to the present embodiment, contacts are exposed on a tip potion of a mating portion. Therefore, the mating contacts are not brought into contact with a holder member when a connector is mated with a mating connector. Accordingly, no shaved wastes are produced. Thus, defective connection between the contacts and the mating contacts can be prevented.

Additionally, tips (embedment parts) of folded parts of the contacts are embedded in a plate portion of the holder member. Therefore, the contacts are less likely to be separated from the holder member.

The present application is based on a Japanese patent application of JP2010-148785 filed before the Japan Patent Office on Jun. 30, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector having a mating portion matable with a mating connector, wherein the connector comprises a plurality of contacts and a holder member holding the plurality of contacts arrayed in a pitch direction, wherein the mating portion has an upper surface, a lower surface, and a tip potion, wherein each of the plurality of contacts includes a contacting part and a folded part, wherein the contacting part is exposed on the upper surface of the mating portion, wherein the contacting part extends frontward and has a front end, wherein the front end is exposed on the tip potion of the mating portion, wherein the folded part is folded backward from the front end of the contacting part and has a rear end as an embedment part, wherein the holder member has a plate portion defining an external shape of the mating portion, and wherein the embedment part is embedded in the plate portion.

2. The connector as recited in claim 1, wherein the plate portion includes a recessed portion that allows at least part of a portion other than the embedment part of the folded part to be seen from below the lower surface of the mating portion.

3. The connector as recited in claim 2, wherein the recessed portion allows all part of the portion other than the embedment part of the folded part to be seen from below the lower surface of the mating portion.

4. The connector as recited in claim 1, wherein the plate portion includes recessed portions and ribs, wherein the recessed portions correspond to the plurality of contacts, respectively, wherein each of the recessed portions allows at least part of a portion other than the embedment part of the folded part of the corresponding contact to be seen from below the lower surface of the mating portion, wherein the ribs and the recessed portions are alternately arranged in the pitch direction, and wherein each of the ribs extends downwardly of the folded parts.

5. The connector as recited in claim 4, wherein the ribs constitute a lower part of the tip portion of the mating portion.

6. The connector as recited in claim 1, further comprising a shell that covers at least part of the holder member, wherein the shell has a shell contacting part that is brought into contact with a mating shell of the mating connector when the connector is mated with the mating connector, wherein the shell is attached to the holder member wherein the shell contacting part is exposed on the lower surface of the mating portion, and a distance from a lower surface of the shell contacting part to a lower surface of the folded part is greater than a thickness of the shell.

7. The connector as recited in claim 1, wherein the plurality of contacts are incorporated in the holder member during formation of the holder member by an insert-molding method.

* * * * *

UNITED STATES PATENT AND TRADEMARK OFFICE

CERTIFICATE OF CORRECTION

PATENT NO. : 8,241,069 B2
APPLICATION NO. : 13/172041
DATED : August 14, 2012
INVENTOR(S) : Takahiro Yamaji It is certified that error appears in the above-identified patent and that said Letters Patent is hereby corrected as shown below:

On the Title Page, Item (57), Under Abstract, Line 5: Replace “potion” with --portion--.

Item (57), Under Abstract, Line 9: Replace “potion” with --portion--.

In the Specifications:

In Column 1, Line 46, Under Summary of the Invention: Replace “potion” with --portion--.

In Column 1, Line 50, Under Summary of the Invention: Replace “potion” with --portion--.

In Column 2, Line 38, Under Description of Preferred Embodiments: Replace “potion” with --portion--.

In Column 3, Line 11: Replace “potion” with --portion--.

In Column 3, Line 38: Replace “potion” with --portion--.

In Column 3, Line 43: Replace “potion” with --portion--.

In Column 3, Line 45: Replace “potion” with --portion--.

In Column 4, Line 15: Replace “potion” with --portion--.

In Column 4, Line 18: Replace “potion” with --portion--.

In Column 4, Line 20: Replace “potion” with --portion--.

In Column 5, Line 5: Replace “potion” with --portion--.

Signed and Sealed this
Twenty-seventh Day of November, 2012

David J. Kappos

David J. Kappos
*Director of the United States Patent and Trademark Office*

In the Claims:

In Column 5, Line 33: (Claim 1, Line 7): Replace “potion” with --portion--.

In Column 5, Line 40: (Claim 1, Line 14): Replace “potion” with --portion--.